US005872345A

United States Patent [19]

Takahashi et al.

[11] Patent Number: 5,872,345

[45] Date of Patent: Feb. 16, 1999

[54] PRESSURE SWITCH

[75] Inventors: Kenji Takahashi, Kariya; Satoshi Suto, Okazaki; Yutaka Mori, Toyohashi; Nobuaki Nonoyama, Kariya; Tomonari Yamakawa, Aichi-ken; Masaya Segi, Okazaki, all of Japan

[73] Assignee: Toyoda Koki Kabushiki Kaisha, Kariya, Japan

[21] Appl. No.: 758,100

[22] Filed: Nov. 29, 1996

[30] Foreign Application Priority Data

Nov. 29, 1995 [JP] Japan ..... 7-310967
Apr. 26, 1996 [JP] Japan ..... 8-107953

[51] Int. Cl.[6] ..... H01H 35/24

[52] U.S. Cl. ..... 200/83 J; 200/83 P

[58] Field of Search ..... 200/83 R, 83 J, 200/83 P, 83 S, 83 N

[56] References Cited

U.S. PATENT DOCUMENTS

| | | | |
|---|---|---|---|
| 4,616,114 | 10/1986 | Strasser | 200/83 J |
| 4,620,073 | 10/1986 | Yokota et al. | 200/83 P |
| 4,758,695 | 7/1988 | Sanford et al. | 200/83 P |
| 5,278,367 | 1/1994 | Homol | 200/83 J |

FOREIGN PATENT DOCUMENTS 37 44 604 7/1989 Germany .

OTHER PUBLICATIONS

Patent Abstract of Japan, vol. 095, No. 009, Oct. 31, 1995, JP 07 147 119, Jun. 6, 1995.

*Primary Examiner*—J. R. Scott
*Attorney, Agent, or Firm*—Oblon, Spivak, McClelland, Maier & Neustadt, P.C.

[57] ABSTRACT

A pressure switch includes a switch housing which has an accommodation bore extending inward from one end of the switch housing, and a slide bore extending between the accommodation bore and the other end of the switch housing. A piston is slidably disposed within the slide bore and is adapted to receive a pressure. A terminal serving as one electric contact is fixed to the accommodation bore via a holding ring made of an insulating material. A disk spring serving as the other electric contact is disposed between the piston and the terminal. The disk spring deforms due to a pressing force of the piston and comes in contact with the terminal. The pressure switch further comprises an annular elastic ring placed on the outer end of the holding ring. An end portion of the switch housing is deformed inward so as to elastically deform the elastic ring, thereby sealing the opening portion of the accommodation bore. The switch housing has a cylindrical portion which has a cylindrical outer shape and into which the holding ring is press-fit, a threaded portion for attachment of the switch housing, and a polygonal tightening portion which is formed between the cylindrical portion and the threaded portion and is used to tighten the switch housing.

6 Claims, 4 Drawing Sheets

PRESSURE SWITCH

BACKGROUND OF THE INVENTION

1. Field of the Invention

The present invention relates to a pressure switch used for detecting a pressure increase in a hydraulic apparatus.

2. Discussion of Related Art

In a hydraulic power steering apparatus used in an automobile or the like, a hydraulic pump is generally driven by an engine, and operation oil discharged from the hydraulic pump is supplied to the hydraulic power steering apparatus so as to assist the driver's steering operation.

In such a hydraulic power steering apparatus, when a steering operation is carried out while the automobile or the like is stopped and therefore the engine is running at its idle rotational speed (hereinafter referred to as "stationary steering operation"), the load pressure of the hydraulic pump increases, resulting in an engine stall. In order to solve this problem, the conventional automobile or the like employs a so-called idle-up mechanism and also employs a pressure switch which detects an increase in the load pressure of the hydraulic pump while the engine is running at the idle speed so as to operate the idle-up mechanism.

FIG. 1 shows an example of such a pressure switch. In FIG. 1, numeral 1 denotes a switch housing, which is attached to a pressure introduction passage 3 formed in a pump housing 2.

In the switch housing 1 is supported a piston 4 which is movable in the axial direction. Load pressure introduced through the pressure introduction passage 3 acts on the piston 4. Disposed above the piston 4 is a terminal 5 serving as one of a pair of electric contacts. This terminal 5 is held by the holding ring 7 via a resin 6 serving as an electrical insulator.

Between the terminal 5 and the piston 4 is disposed a disk spring 8 serving as the other electric contact. When the piston 4 presses the disk spring 8, the disk spring 8 comes in contact with the terminal 5. The disk spring 8 is held between the holding ring 7 and the switch housing 1, and is grounded to a vehicle body via the switch housing 1 and the pump housing 2.

The holding ring 7 is placed into an accommodation bore 1*a* formed in the switch housing 1, and an end portion 1*b* of the switch housing 1 is deformed inward through caulking, so that the holding ring 7 is fixed to the switch housing 1, thereby positioning the disk spring 8. After the caulking, a resin 9 is charged into the opening portion of the accommodation bore 1*a* so as to seal the opening portion.

When the load pressure of the hydraulic pump increases due to a stationary steering operation while the engine is running at the idle speed, the increased pressure acts on the piston 4, so that the piston 4 slides against the spring force of the disk spring 8. Consequently, the piston 4 elastically deforms the disk spring 8, thereby bringing it into contact with the terminal 5. With this operation, electrical conduction is established between the pump housing 2 and the terminal 5, so that an electrical signal for idle-up is generated.

Since such a pressure switch is disposed in an engine space, the adhesive force between the end portion (caulked portion) 1*b* of the switch housing 1 and the resin 9 charged in the opening of the accommodation bore 1*a* decreases due to salt damage caused by antifreezing agents scattered on roads or due to thermal shock, resulting in formation of a gap between the resin 9 and the caulked portion 1*b*. In this case, moisture and the like enters the inside of the switch housing 1 through the gap and causes adverse effects on the electric contact portion between the disk spring 8 and the terminal 5.

In the conventional pressure switch, a thread is formed on the outer circumference 1*c* of the lower end of the switch housing 1, and the lower end of the switch housing 1 is screwed into a threaded hole 2*a* formed at the opening end of the pressure introduction passage 3 of the pump housing 2 of the hydraulic pump.

In order to screw the switch housing 1 into the pump housing 2, an intermediate portion 1*d* of the switch housing 1 has a hexagonal shape. Since the hexagonal intermediate portion 1*d* overlaps with the press-fit portion of the holding ring 7 and the inner circumference of the intermediate portion 1*d* is circular so as to accommodate the holding ring 7, the intermediate portion 1*d* has thin-wall portions on which stress is concentrated upon press-fitting of the holding ring 7. When the concentrated stress exceeds the breaking point of the material of the switch housing 1, the holding ring 7 becomes loose, resulting in positional shift of the disk spring 8.

This problem also occurs when the switch housing 1 is screwed into the pump housing 2. That is, when a spanner or a like tool other than a box wrench is used to screw the switch housing 1 into the pump housing 2, the intermediate portion 1*d* of the switch housing 1 deforms, so that the holding ring 7 becomes loose, resulting in positional shift of the disk spring 8. Even when a box wrench is used, a similar problem occurs if the switch housing 1 is tightened with a force exceeding a predetermined torque.

This causes a possibility that the pressure switch does not become ON even when a predetermined pressure acts on the pressure switch, resulting in degradation of the performance of the pressure switch.

SUMMARY OF THE INVENTION

An object of the present invention is to solve the above-described problems and to provide an improved pressure switch that is hardly affected by external factors such as salt damage and thermal shock.

Another object of the present invention is to provide a pressure switch having a structure that prevents stresses generated upon press-fitting of a holding ring from concentrating within a switch housing and also prevents the holding ring from causing positional shift which would otherwise occur due to tightening torque upon attachment of the switch housing.

The present invention provides improvements on a pressure switch which includes a switch housing having an accommodation bore extending inward from one end of the switch housing, and a slide bore extending between the accommodation bore and the other end of the switch housing; a piston slidably disposed within the slide bore and adapted to receive a pressure; a terminal serving as one electric contact and fixed to the accommodation bore via an electrical insulator; and a disk spring serving as the other electric contact and disposed between the piston and the terminal, wherein the disk spring deforms due to a pressing force of the piston and comes in contact with the terminal.

According to a first aspect of the present invention, the pressure switch further includes an annular elastic ring placed on one end of the insulator such that it is located at an opening portion of the accommodation bore. An end portion of the switch housing is deformed inward so as to elastically deform the elastic ring, thereby sealing the opening portion of the accommodation bore. Preferably, the annular elastic ring is made of rubber and has a circular cross section.

In the pressure switch according to the first aspect of the present invention, an annular elastic ring is provided at the opening portion of the accommodation bore of the housing, and the end portion of the housing is deformed through caulking so as to elastically deform the annular elastic ring, thereby securing sealing at the opening portion of the accommodation bore. Therefore, even when the deformed end portion of the housing opens radially outwards due to thermal shock or the like, the sealing can be maintained through elastic restoration of the annular elastic ring. In addition, manufacturing facilities can be simplified, assembly work becomes easier, and reliability is enhanced, as compared with the case in which resin is charged into the opening portion of the accommodation bore.

According to another aspect of the present invention, the switch housing includes a cylindrical portion which has a cylindrical outer shape and into which a holding ring made of an insulating material is press-fit, a threaded portion for attachment of the switch housing, and a polygonal tightening portion which is formed between the cylindrical portion and the threaded portion and is used to tighten the switch housing. In this case, the tightening portion preferably has a hexagonal outer shape.

In the pressure switch according to the second aspect of the present invention, since the portion of the switch housing into which the holding ring is press-fit has a cylindrical outer shape, stress concentration does not occur within the switch housing even when the holding ring is press-fit into the switch housing. In addition, even when the switch housing is tightened, the holding ring does not become loose due to tightening torque, so that the holding ring is prevented from causing positional shift. Accordingly, it is possible to reliably maintain the performance of the pressure switch.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiment when considered in connection with the accompanying drawings, in which.

DETAILED DESCRIPTION OF THE PREFERRED EMBODIMENT

An embodiment of the present invention will now be described with reference to the drawings.

Figure 1:
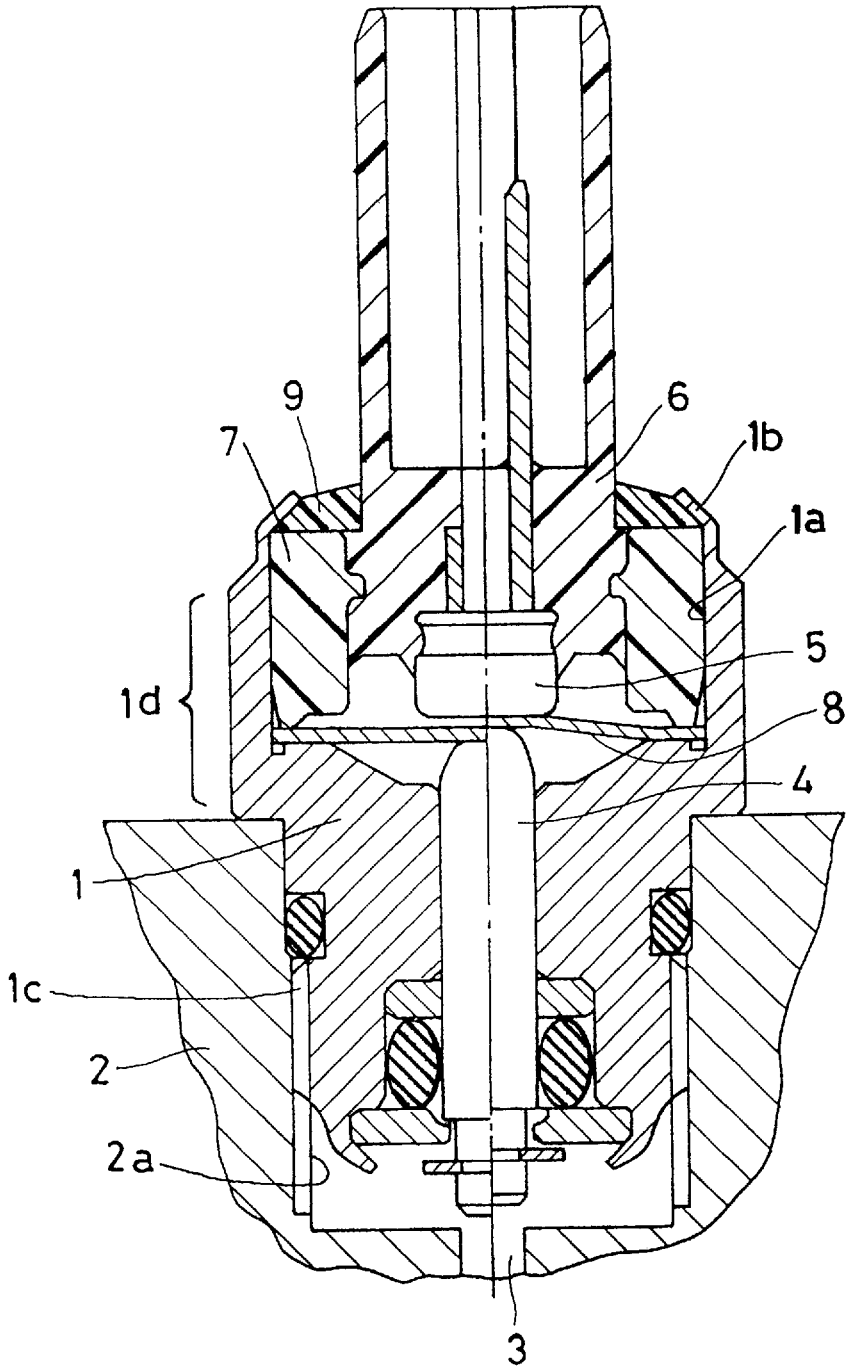
FIG. 1 (PRIOR ART)
FIG. 1 is a sectional view showing a conventional pressure switch.
Figure 2:
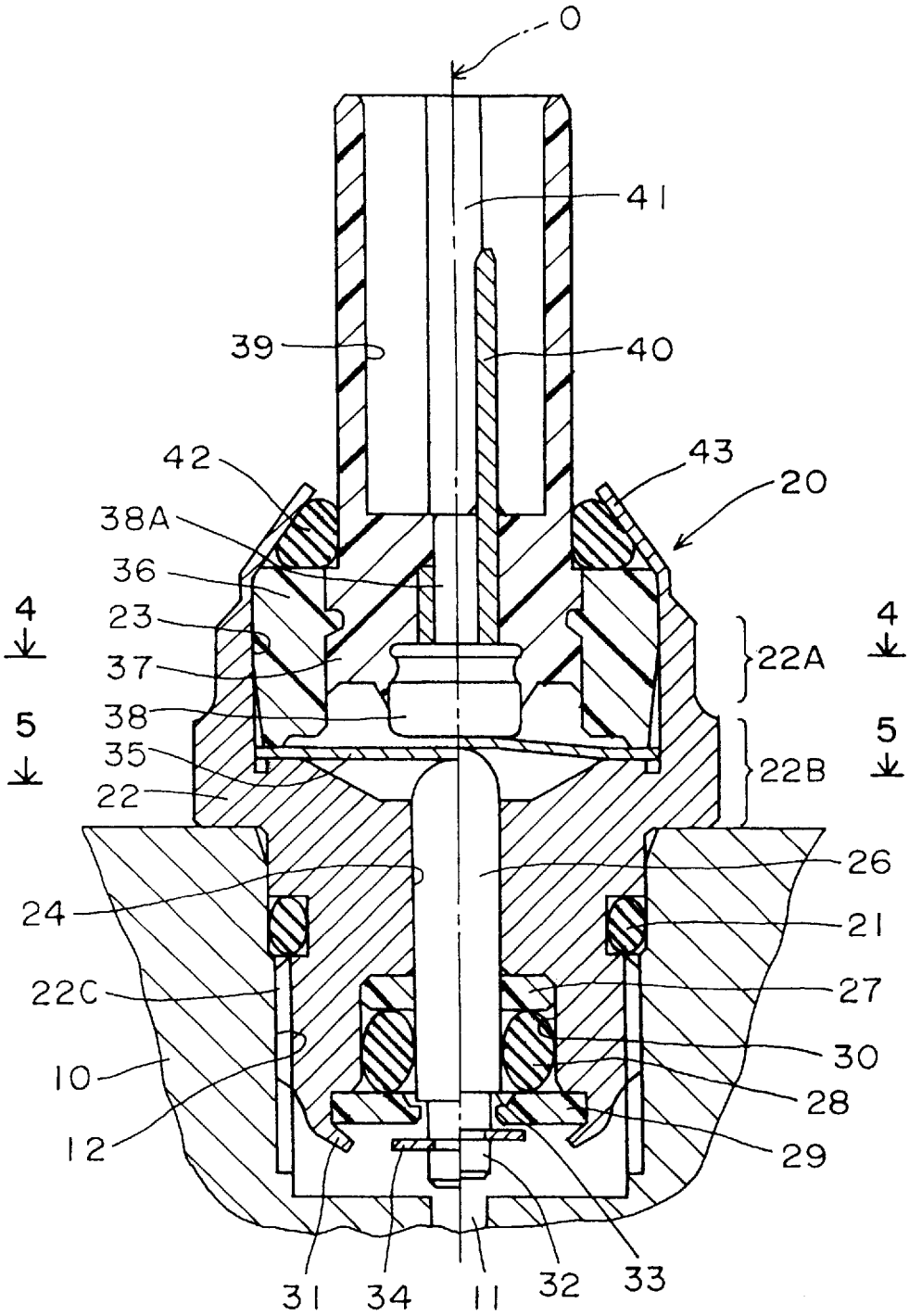
FIG. 2 is a sectional view of a pressure switch according to an embodiment of the present invention.

FIG. 2 shows a sectional view of a pressure switch according to an embodiment of the present invention. In FIG. 2, the left side of a center axis O depicts a state in which no load pressure acts on the pressure switch, while the right side of the center axis O depicts a state in which a load pressure acts on the pressure switch.

In FIG. 2, numeral 10 denotes a pump housing of a hydraulic pump. In the pump housing 10 is formed a pressure introduction passage 11. A pressure switch 20 according to the present invention is screwed into a threaded hole 12 formed at the opening end of the pressure introduction passage 11, with a seal ring 21 being interposed between the threaded hole 12 and the pump housing 10 so as to secure fluid-tightness.

The switch housing 22 of the pressure switch 20 is an integral body having an accommodation bore 23 that has a larger diameter and extends inward from one end of the switch housing 22, as well as a slide bore 24 that has a smaller diameter and extends between the accommodation bore 23 and the other end of the switch housing 22. On the outer circumferential surface of the other end of switch housing 22 is formed a threaded portion 22*c* for screw engagement with the threaded hole 12 of the pump housing 10.

A piston 26 is slidably inserted into the slide bore 24 such that the tip end of the piston 26 projects into the accommodation bore 23. A depression 30 is formed at the opening end (lower end in FIG. 2) of the slide bore 24 so as to accommodate therein a Teflon ring 27, an O-ring 28, and an engagement member 29, in this order with respect to the direction toward the pressure introduction passage 11. The outer circumferential surface of the piston 26 is in close contact with the inner circumferential surface of the O-ring 28. A thin-wall portion 31 of the lower end of the switch housing 22, which end corresponds to the depression 30, is deformed inward through caulking or crimping, so that the Teflon ring 27, the O-ring 28, and the engagement member 29 are prevented from moving axially.

The piston 26 has a smaller diameter portion 32 at its one end which faces the pressure introduction passage 11. Movement of the piston 26 toward the pressure introduction passage 11 is limited by engagement between the engagement member 29 and a stepped portion 33 formed at the root of the smaller diameter portion 32. Moreover, a stopper ring 34 is attached to the outer circumference of the smaller diameter portion 32. Engagement between the stopper ring 34 and the engagement member 29 prevents the piston 26 from excessively moving toward the accommodation bore 23 even when an abnormal pressure acts on the piston 26.

Figure 3:
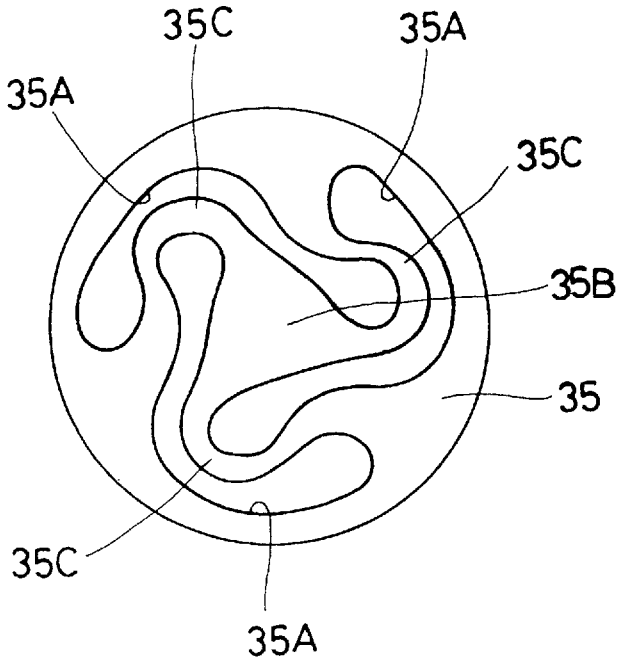
FIG. 3 is a sectional view showing an example of a disk spring.

At the bottom of the accommodation bore 23 is disposed a disk spring 35 having a shape shown in FIG. 3. This disk spring 35 is held at its outer circumferential edge by the holding ring 36, which is press-fit into the accommodation bore 23. The disk spring 35 is formed of metallic thin plate and has three cut portions 35A which extend from the outer edge toward the center of the disk spring 35, so that there is formed a center portion 35B which is supported by flexible portions 35C formed by the cut portions 35A. When a force greater than a predetermined level is applied onto the center portion 35B, the flexible portions 35C deform, and the center portion 35B moves accordingly. The disk spring 35 is grounded to the vehicle body via the switch housing 22 and the pump housing 10.

The holding ring 36 holds a terminal 38 to which voltage is applied. Before the holding ring 36 is press-fit into the switch housing 22, the terminal 38 is placed within and attached to the holding ring 36 via a support 37 made of resin serving as an insulating material. The support 37 extends upward in FIG. 2 so as to form an attachment bore 39 into which an unillustrated connector is inserted. A connection terminal 40 is connected to a shaft portion 38A of the terminal 38 and projects into the attachment bore 39 for engagement with the unillustrated connector. In FIG. 2, numeral 41 denotes a guide groove for guiding the connector within the attachment bore 39 when the connector is inserted into the attachment bore 39. Numeral 42 denotes an O-ring made of rubber and having a circular cross section. The O-ring 42 is placed within the opening portion of the accommodation bore 23 such that it sits on the upper end surface of the holding ring 36 and is in close contact with the outer circumference of the support 37. A thin wall end portion 43 of the switch housing 22, which surrounds the accommodation bore 23, is deformed inward through caulking so as to elastically deform the O-ring 42, so that the opening portion of the accommodation bore 23 is sealed. Also, through caulking, the holding ring 36 is fixed to the switch housing 22 via the O-ring 42, so that the disk spring 35 is held in place.

When the holding ring 36 carrying the terminal 38 is fit into the switch housing 22, the tip end of the terminal 38 faces the center portion 35B of the disk spring 38, which is in a free state, with a small clearance being formed therebetween. The tip of the terminal 38 contacts the center portion 35B of the disk spring 38 when the disk spring 38 deforms slightly.

Figure 4:
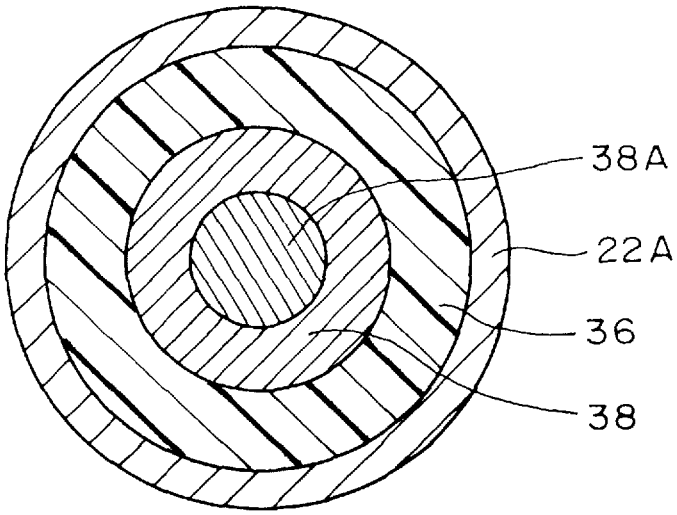
FIG. 4 is a sectional view taken along the line 4—4 in FIG. 2.

At a portion 22A of the switch housing 22 into which the holding ring 36 is press-fit, the switch housing 22 has a cylindrical outer shape, as shown in FIG. 4 (cross section along the line 4—4 in FIG. 2).

Figure 5:
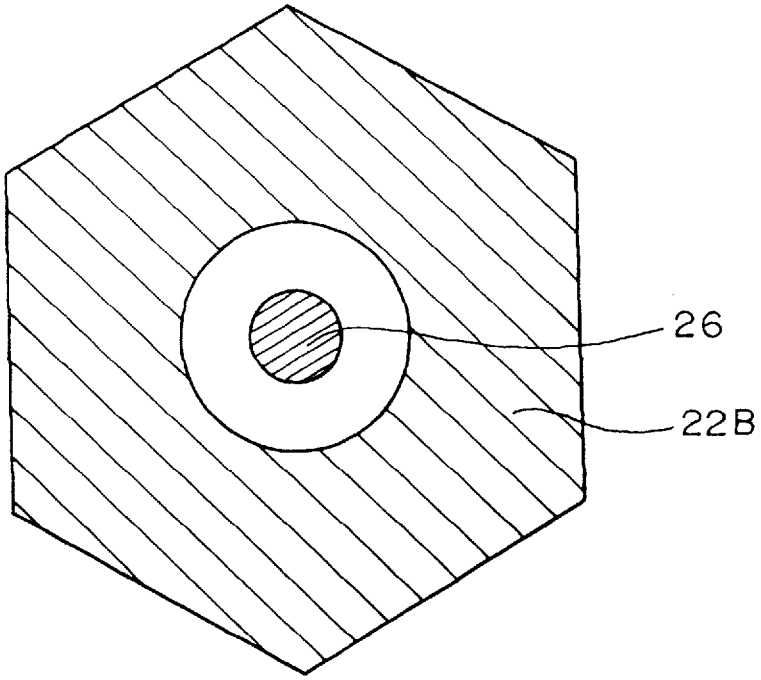
FIG. 5 is a sectional view taken along the line 5—5 in FIG. 2.

At a portion 22B below the portion 22A, the switch housing 22 has a hexagonal outer shape, as shown in FIG. 5 (cross section along the line 5—5 in FIG. 2). That is, the hexagonal portion 22B is formed such that it does not overlap with the portion of the switch housing 22 into which the holding ring 36 is press-fit. When the switch housing 22 is attached to the pump housing 10, a tool such as a box wrench is engaged with the hexagonal portion 22B.

When the pressure switch 20 is manufactured, the holding ring 36 is press-fit into the switch housing 22. Since the portion 22A of the switch housing 22, into which the holding ring 36 is press-fit, has a cylindrical outer shape, no stress concentration occurs within the housing 22.

When the pressure switch 20 is attached to the pump housing 10, a tool such as a box wrench is engaged with the hexagonal portion 22B so as to apply a tightening torque to the switch housing 22. However, since the hexagonal portion 22B is formed such that it does not overlap with the portion of the switch housing 22 into which the holding ring 36 is press-fit, the holding ring 36 is prevented from becoming loose due to the tightening torque.

Next, the operation of the pressure switch 20 having the above-described structure will be described.

When a steering wheel is rotated, the load pressure of the hydraulic pump increases, and the increased load pressure is introduced into the pressure switch 20 via the pressure introduction passage 11. As a result, the load pressure acts on one end of the piston 26, so that the disk spring 35 is pressed by the piston 26. However, when the amount of rotation of the steering wheel is small, the load pressure does not increase very much, and a clearance remains between the disk spring 35 and the terminal 38, so that the terminal 38 does not electrically communicate with the pump housing 10 via the disk spring 35.

However, in the case where the load pressure of the hydraulic pump increases due to a stationary steering operation while the engine is running at its idle speed, the load pressure of the hydraulic pump increases greatly. When the load pressure increases to such a degree as to overcome the spring force of the disk spring 35, the disk spring 35 deforms due to the pressing force of the piston 26, so that the disk spring 35 comes into contact with the terminal 38. As a result, the terminal 38 electrically communicates with the housing 10, so that an electrical signal for idle-up is generated.

Obviously, numerous modifications and variations of the present invention are possible in light of the above teachings. It is therefore to be understood that within the scope of the appended claims, the present invention may be practiced otherwise than as specifically described herein.

What is claimed is:

1. A pressure switch comprising:

an electrically conductive switch housing having an accommodation bore extending inward from one end of said switch housing and a slide bore extending between said accommodation bore and the other end of said switch housing;

a piston slidably disposed within said slide bore and adapted to receive a pressure;

a terminal serving as one electric contact and fixed to said accommodation bore via an electrical insulator;

a disk spring positioned in said accommodation bore and in electrically conductive communication with said switch housing, said disk spring serving as the other electric contact and disposed between said piston and said terminal, said disk spring deforming due to a pressing force of said piston and coming in contact with said terminal; and an annular elastic ring placed on one end of said insulator such that the annular elastic ring is located at an opening portion of said accommodation bore, said annular elastic ring being deformed by engagement with an inwardly bent end portion of said switch housing, whereby the opening portion of said accommodation bore is sealed.

2. A pressure switch according to claim 1, wherein said annular elastic ring is made of rubber and has a circular cross section.

3. A pressure switch comprising:

an electrically conductive switch housing having an accommodation bore extending inward from one end of said switch housing and a slide bore extending between said accommodation bore and the other end of said switch housing;

a piston slidably disposed within said slide bore and adapted to receive a pressure;

a terminal serving as one electric contact and fixed to said accommodation bore via a holding ring made of an insulating material; and a disk spring positioned in said accommodation bore and in electrically conductive communication with said switch housing, said disk spring serving as the other electric contact and disposed between said piston and said terminal, said disk spring deforming due to a pressing force of said piston and coming in contact with said terminal, wherein said switch housing comprises an integral body including a cylindrical portion which has a cylindrical outer shape and into which said holding ring is press-fit, a threaded portion for attachment of said switch housing, and a polygonal tightening portion which is formed between said cylindrical portion and said threaded portion and is used to tighten said switch housing.

4. A pressure switch according to claim 3, wherein said tightening portion has a hexagonal outer shape.

5. A pressure switch according to claim 3, further comprising an annular elastic ring which is placed on one end of said holding ring such that it is located at an opening portion of said accommodation bore, said annular elastic ring being deformed by inwardly bending an end portion of said switch housing, whereby the opening portion of said accommodation bore is sealed.

6. A pressure switch according to claim 5, wherein said annular elastic ring is made of rubber and has a circular cross section.

* * * * *